US006293422B1

(12) United States Patent
Jentzsch et al.

(10) Patent No.: US 6,293,422 B1
(45) Date of Patent: Sep. 25, 2001

(54) CONTAINER WITH COMBINATION CONVEX/CONCAVE BOTTOM

(75) Inventors: K. Reed Jentzsch, Arvada; Otis Willoughby, Louisville; Dan A. Edwards, Westminster, all of CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 09/520,602

(22) Filed: Mar. 8, 2000

(51) Int. Cl.[7] ..... B65D 7/00
(52) U.S. Cl. ..... 220/608; 220/606; 220/906
(58) Field of Search ..... 220/606, 608, 220/609, 623, 628, 635, 906

(56) References Cited

U.S. PATENT DOCUMENTS 3,043,461 * 7/1962 Glassco ..... 220/609 X
4,175,670 * 11/1979 Reynolds et al. ..... 220/606
4,352,435 * 10/1982 Yoshino et al. ..... 220/606 X
4,426,013 * 1/1984 Cherchian et al. ..... 220/906 X
4,452,368 * 6/1984 Roth ..... 200/906 X
4,732,292 * 3/1988 Supik ..... 220/906 X
5,469,984 * 11/1995 Kalkanis ..... 220/606
5,680,952 * 10/1997 Chasteen ..... 220/906 X

* cited by examiner

*Primary Examiner*—Steven Pollard
(74) *Attorney, Agent, or Firm*—Sheridan Ross P.C.

(57) ABSTRACT

An aluminum one-piece container body, defining a sidewall and bottom, has a substantially hemispherical or otherwise convex, preferably curvilinear, surface surrounding a central concave panel. A plurality of feet extend downwardly from the convex region. The convex region provides strength advantages associated with containing pressurized material. A concave panel accommodates changes in differential pressures such as arising from pasteurization or other heating. The feet are preferably configured to provide substantial stackability and conveyability as well as support stability for the container.

7 Claims, 3 Drawing Sheets

FIG. 2
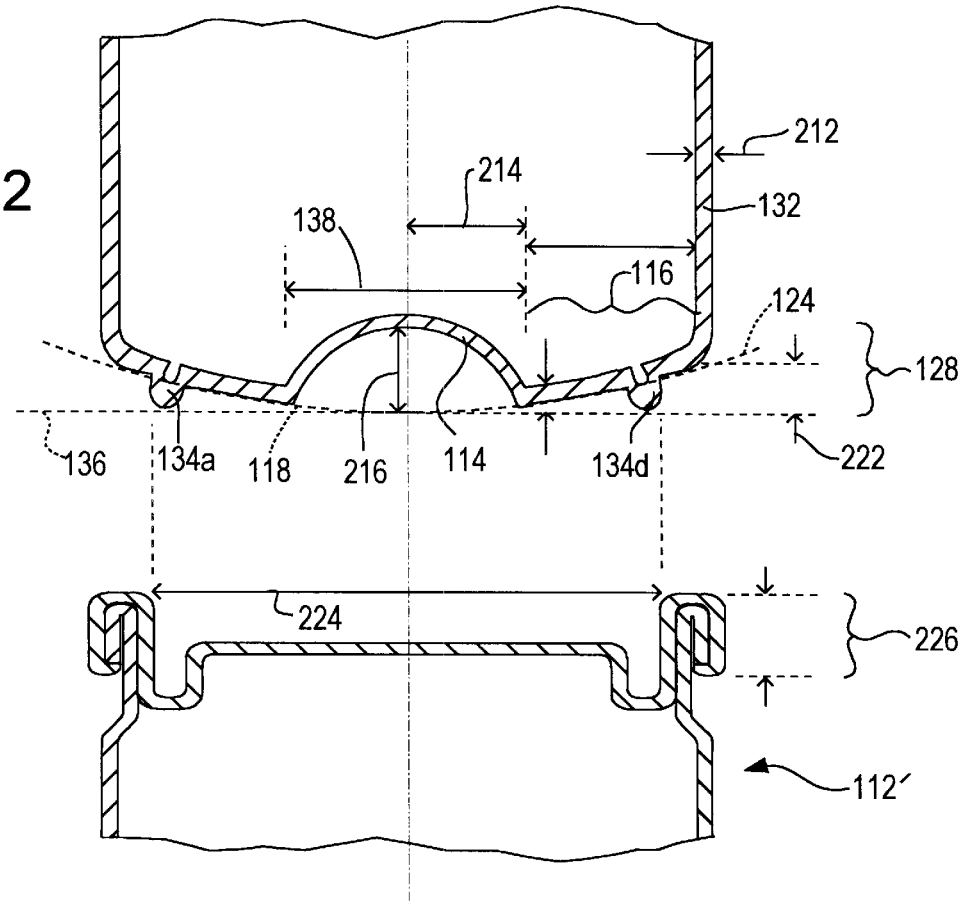
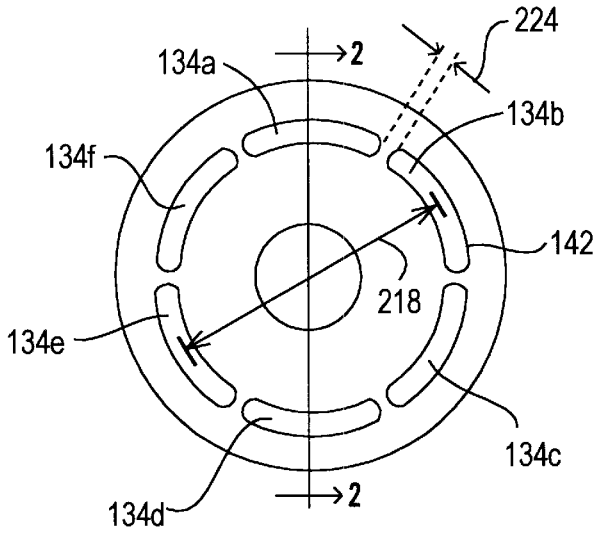
FIG. 3

CONTAINER WITH COMBINATION CONVEX/CONCAVE BOTTOM

BACKGROUND INFORMATION

A typical approach to providing beverage or other containers (such as, commonly, 12 ounce to 32 ounce pop or beer containers), involves a two piece construction procedure involving forming a body piece which contains a (typically cylindrical) sidewall and a bottom, all formed from a single piece of metal, typically aluminum, and a second top or cover piece joined to the rim of the body piece, e.g. by a seaming or curling operation. An important consideration in designing and fabricating such containers involves providing a desirable balance between minimizing material requirements (such as providing relatively thin-gauge metal) while achieving a container that will maintain its integrity and/or form, despite shipping and handling impacts or forces and despite impact or forces arising from dropping containers and the like. Moreover, it is typically desired to provide containers which maintain integrity and/or form even when contents are under pressure (e.g. a rising from carbonated or otherwise gas-pressured contents and/or arising from high temperatures, including, in some cases, pasteurization temperatures).

Theoretical analysis and practical experience both indicate that it can be advantageous to provide a bottom shape which is substantially convex (when viewed from the outside). Theoretical analysis indicates that a bottom shape which is in the form of a hemispherical section, outwardly convex, provides substantially the greatest strength, especially for pressurized contents.

A convex bottom shape can also be of assistance, in reducing materials costs, by providing additional interior volume (compared, e.g., to a concave bottom shape), in some cases making it possible to reduce the sidewall height of a container (and thus reduce materials costs) while retaining the same interior volume available for container contents. Nevertheless, an outwardly convex or hemispherical bottom shape is not typically provided in mass-produced metal beverage (and other) containers. A more common bottom configuration for a beverage container involves a bottom panel which is concave (viewed from the outside) over the majority of the bottom surface (e.g. except for formation of a support rim), such as those described and depicted in U.S. Pat. No. 5,836,473.

As the container industry has developed, there has been an increase in factors favoring further reduction of materials costs without substantially sacrificing strength. Accordingly, it would be useful to provide a design which can take advantage of the strength characteristics associated with a hemispherical or otherwise outwardly convex bottom shape.

A number of factors place constraints on container shape and design. For containers which are to be mass produced, such as typical pop, beer or similar containers, the design must be compatible with high-speed manufacturing and is preferably achieved while making only minimum modifications to fabrication lines. Such manufactureability considerations have made it difficult or infeasible to implement at least some convex-bottom shapes, especially when container bodies are fabricated from aluminum. Without wishing to be bound by any theory, it is believed that this is at least partially because of the relatively limited ductility or stretchability of aluminum, e.g. compared to steel or other potential container metals. Many potential container bottom shapes with convex proportions are believed to be substantially unmanufactureable, e.g. in aluminum (in a mass production setting) because the limited ductility of aluminum leads to rupture, buckling or folding during container body formation processes. In many instances, while it might be theoretically possible to form aluminum into certain desired shapes, such formation would require the addition of equipment or would require a slowdown of production of a magnitude making it infeasible or undesirable in a mass production environment. Because of the properties of aluminum, it is, in general, not feasible to conclude that a shape that can be formed in another material, such as another metal, or a plastic, can be feasibly formed in aluminum, especially in a mass-production fashion. Accordingly, it would be useful to provide a configuration which can take advantage of the strength characteristics available from an (at least partially) convex or hemispherical bottom shape, but which is feasible for production, especially for aluminum container bodies, in a high-throughput, mass production environment, preferably without requiring substantial additional equipment or fabrication stations and/or without requiring a slowdown of production rates.

In addition to design constraints imposed by manufactureability, a number of other factors are profitably considered, including stackability and conveyability. Stackability refers to the ability to vertically stack one can on top of another, preferably to achieve multiple-can heights of a stack. Typically, stackability involves designing a container bottom in conjunction with the design of the container top, e.g. to achieve desired nesting and clearance characteristics and generally to achieve desired stackability. Conveyability refers to the ability to slide or otherwise convey a (typically vertically-oriented) container along a tray or trough surface, roller surface, belt surface and the like, while avoiding tipping or "stumbling" of containers during conveyance. Accordingly, it would be useful to provide a container which may take advantage of increases in strength associated with a container bottom having a (at least partially) convex or hemispherical shape while providing desired stackability and conveyability characteristics.

Another design factor involves the ability of a container to accommodate changes in differential pressure, such as pressure arising from carbonation or other pressurization of contents, pressure arising from changes in temperature, such as temperatures ordinarily encountered during shipment storage and the like and/or processing temperatures, including, in some cases, pasteurization processes. In some situations, differential pressure changes can arise from changes in the external environment such as conveyance or use of containers in aircraft or other reduced-pressure environments. Accordingly, it would be useful to provide a container bottom design which could take advantage of the increased strength associated with providing a container bottom with an (at least partially) convex shape or hemispherical shape while accommodating reasonably anticipated changes in differential pressure (i.e. pressure differences between internal pressure and external pressure).

SUMMARY OF THE INVENTION

The present invention provides a one piece metal (preferably aluminum) container body having a central portion which is concave (when viewed from the outside) surrounded by an annular region, at least a portion of which defines or lies along a hemispherical or other convex, preferably curvilinear, surface with a plurality of discrete feet extending downwardly therefrom to define a support surface or plane. By providing an annular portion which defines a hemispherical or otherwise convex surface, the present invention takes advantage of increased strength associated with such a shape. By providing a central concave panel, the present invention can accommodate changes in pressure differential. By providing feet extending from the bottom surface, the container can be stablely supported in an upright fashion, despite the presence of the convex regions. By providing feet which are discrete (distinct from one another) a container body is provided which is substantially manufactureable, i.e. can be manufactured, preferably in aluminum, without undue proliferation of manufacturing steps or slowdown of manufacturing procedures.

Although a number of foot configurations are possible, in one embodiment feet are configured with a substantially arcuate shape, substantially concentric with the (preferably circular) container perimeter. The foot configuration thus can provide a significant shoulder height for achieving desired stackability and/or substantial length and/or area of contact surface or support surface, e.g. for desired conveyability.

In one aspect, an aluminum one-piece container body, defining a sidewall and bottom, has a substantially hemispherical or otherwise convex, preferably curvilinear, surface surrounding a central concave panel. A plurality of feet extend downwardly from the convex region. The convex region provides strength advantages associated with containing pressurized material. A concave panel accommodates changes in differential pressures such as arising from pasteurization or other heating. The feet are preferably configured to provide substantial stackability and conveyability as well as support stability for the container.

BRIEF DESCRIPTION OF THE DRAWINGS

FIG. 2 is a partial cross section view, partially exploded of stacked first and second containers according to an embodiment of the present invention;

FIG. 3 is a bottom plan view of a container according to an embodiment of the present invention;

DETAILED DESCRIPTION OF THE PREFERRED EMBODIMENTS

Figure 1:
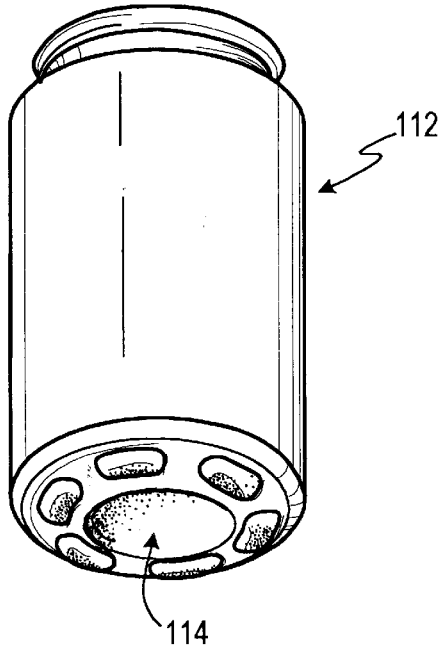
FIG. 1 is a bottom perspective view of a container body according to an embodiment of the present invention.

As depicted in FIG. 1, in one embodiment a one-piece aluminum alloy container body 112 includes a central, substantially concave (when viewed from the outside) region or panel 114. As seen in FIG. 2, an annular region 116 surrounds the central region 114 and at least portions of the annular region 116 (in the depicted embodiment, those portions which are not used for defining the feet regions) defines or lies along a substantially hemispherical surface 118. As will be understood by those of skill in the art, dimensions and/or ranges will depend, at least, on the size of the container (the desired container volume) the anticipated differential pressures, and similar factors. Table I provides approximate dimensions or approximate ranges of dimensions with respect to a 12 ounce (355 ml) beverage container, for one embodiment.

TABLE I

Approximate dimensions or approximate ranges for a 12 oz. (355 ml) container.

| | |
|---|---|
| wall thickness (212) | 0.05 mm to 0.2 mm |
| concave panel radius (214) | 1 cm to 4 cm |
| concave panel depth (216) | 0.3 cm to 1.5 cm |
| support surface diameter (218) | 3 cm to 6.5 cm |
| foot shoulder height (222) | 2 mm to 6 mm |
| inter-foot gap (224) | 2 mm to 10 mm |

Although the annular region 116 lies along or defines a substantially hemispherical shape 118, in the embodiment of FIG. 2, other convex shapes are possible for the hemispherical region 116, including, for example, parabolic surfaces, ellipsoidal surfaces, bi-radial surfaces, and the like. Preferably, some or all of the annular region 116 has a curvilinear shape (i.e. with a substantially continuous differential function), although it is also possible to provide non-curvilinear shapes such as shapes defined by conic sections and the like, preferably, for manufactureability, the region 124, defining the conjunction of the bottom 128 with the sidewall 132, has a rounded or curvilinear (as opposed to angular) shape.

As depicted in FIGS. 1, 2 and 3, a plurality of discrete feet 134*a–f* project outwardly or downwardly from the annular region 116 a distance or height 222 to collectively define a support surface or plane 136. In the absence of the feet 134*a–f*, the container 112 would rest on the rim of the concave portion 114, providing a relatively small diameter 138 support area. The feet 134*a–f* provide a support surface having a substantially larger diameter 218 to provide greater stability, e.g. for support and/or conveyance. Additionally, the outer perimeters 142 of the feet define a shoulder region having a height 222 and a diameter 224 substantially fitting within the height 225 and diameter of atop 226 of an adjacent (stacked) container 112' to achieve desired stackability. By providing feet 134 having a substantially arcuate shape (FIG. 3), the feet 134 provide a support region having a circumference nearly equal to the theoretical maximum circumference (e.g. except for the inter-foot gaps 224), thus contributing to secure stackability (so as to avoid stack tip-over) and assisting in conveyability (so as to avoid stumbling or tipping during conveyance).

To assist in providing for stability and conveyability, the feet portions preferably occupy a substantial portion of the circumferential extent of the bottom portion. Preferably, the foot portions occupy at least about 120°, preferably at least about 200°, more preferably at least about 270° and even more preferably at least about 300° of the total 360° circumferential extent of the bottom portion.

In the embodiment of FIG. 3, each inter-foot gap occupies about 10° of the total 360° circumferential extent of the bottom and accordingly the feet collectively occupy about 300° of the circumferential extent of the bottom portion.

Figure 4:
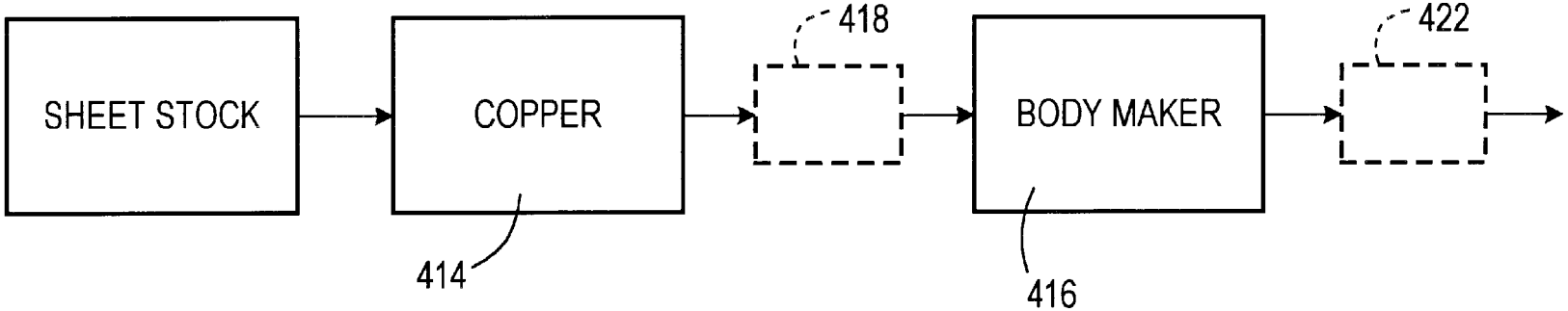
FIG. 4 is a flow chart depicting can processing steps useable in connection with the forming containers according to embodiments of the present invention.

Preferably the configuration as illustrated in FIGS. 1–3 can be formed with relatively minor modifications to existing fabrication systems, preferably without adding additional fabrication stations to existing container fabrication lines. In one embodiment, stamping or drawing dies are inserted into the interior of a preform, or cup, at a cupper station 414 or at a bodymaker station 416 (FIG. 4). It has been found that configurations including as described herein can be manufactured in this fashion, at existing manufacturing stations 414, 416 while substantially avoiding rupture or distortion, even using relatively thin-gauge aluminum.

Without wishing to be bound by any theory, it is believed that at least some other potential designs having or defining hemispherical or convex bottom shapes (including designs which might, at first, appear to be only slightly different from those described and depicted herein) cannot be feasibly manufactured, at least in thin-gauge aluminum at mass production rates substantially using current production devices or procedures.

For at least some embodiments of the invention, it is believed useful and/or necessary to perform bottom shaping in at least two steps. Accordingly, in at least some embodiments, bottom forming (including inserting tooling into the interior of the preform or body) is performed in both a cupper stage 414 and a bodymaker stage 416. By performing two steps in two existing production stages, cupping 414 and bodymaking 416, it is, in at least some embodiments, possible to avoid introducing additional stages or steps. It would at least theoretically be possible to provide at least some steps of a multiple-step process in a production stage 418 between a cupper stage 414 and a bodymaker stage 416 and/or after 422 a bodymaker stage 416. As one example the system can be configured to create stacking grooves, including grooves formed in some or all of the feet of a container, with the groove(s) being configured to mate with a rim (or other portion) of a top of an adjacent container, to facilitate stacking of cans and avoid tipping of stacks. In one embodiment, such stacking grooves are produced at locations 422 after the bodymaker (although prior locations are also possible). In one embodiment, stacking grooves are produced after a necking operation. If desired, the system can be configured, for example, to accommodate stacking of 2-¼ inch diameter containers or 2-⅛ inch diameter containers, allowing the line "front end" to produce one size container.

Figure 5:
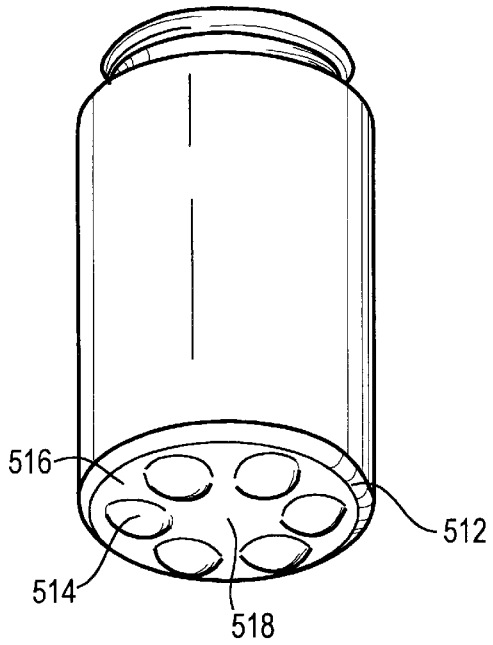
FIG. 5 is a bottom perspective view of a container body according to an embodiment of the present invention.
Figure 6:
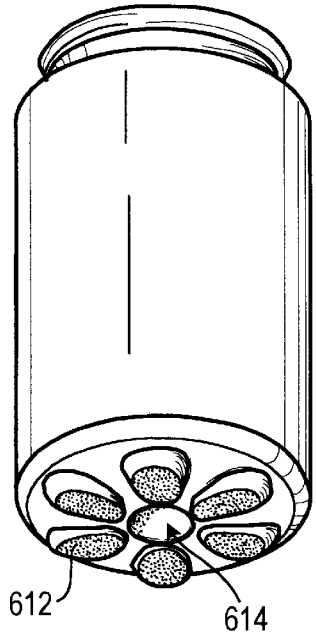
FIG. 6 is a bottom perspective view of a container body according to an embodiment of the present invention.
Figure 7:
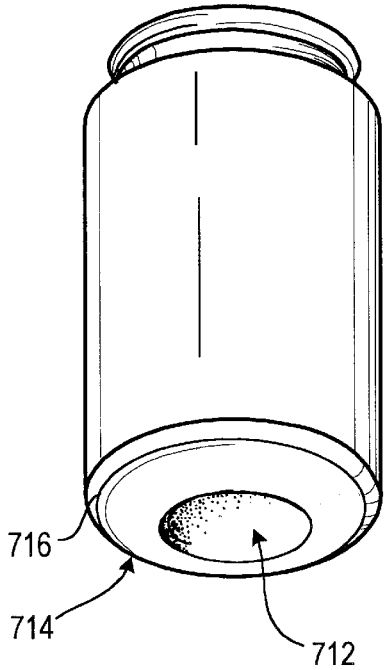
FIG. 7 is a bottom perspective view of a container body according to an embodiment of the present invention.

FIGS. 5–7 depict bottom configurations according to other embodiments of the present invention. In the embodiment of FIG. 5, the bottom region 512 includes a plurality of substantially round (rather than arcuate) feet 514 projecting downward from a substantially hemispherical or convex bottom surface 516 which, in the depicted embodiment, does not include a concave panel in the central region 518.

In the embodiment of FIG. 6, the discrete feet 612 are radially elongated, leaving a relatively smaller central region available for placement of a concave panel 614.

In the embodiment of FIG. 7, the central concave panel 712 is relatively larger (e.g. compared to the embodiment of FIG. 6) and the support surface 714 has a convex region without discrete supporting features, but which could be used as a preform for adding discrete feet or other supporting features. In the embodiment of FIG. 7, an inwardly curving or shoulder feature 716 adds strength to the convex or dome region, e.g. under axial loading.

In light of the above description, a number of advantages of the present invention can be seen. The present invention provides a container configuration which is manufactureable, i.e. feasible to be manufactured substantially using current manufacturing stages or processes with relatively little need for modification or addition, while providing the strength enhancement associated with an (at least partially) hemispherical or otherwise convex dome shape for the container bottom. The present invention provides desirable stackability and conveyability characteristics. The present invention can accommodate relatively high differential pressures and relatively large changes in differential pressure, e.g. during processing, shipping, storage and the like. The present invention can provide reduced materials costs, including facilitating the use of relatively thin-gauge aluminum body material and/or reducing sidewall height without reducing container volume.

A number of variations and modifications of the invention can be used. It is possible to use some features of the invention without using others. For example, it is possible to provide a convex-bottomed aluminum beverage container without accommodating pasteurization-level pressure differentials. Although the present invention is believed particularly useful in connection with aluminum container fabrication, there is no theoretical reason why the configurations depicted and described herein cannot be used with other materials such as steel. Although embodiments were described in connection with a container sized to accommodate a 355 milliliter volume, the present invention can also be used in connection with larger and/or smaller containers. The present invention can be used in connection with a variety of opening configurations or devices including lift-tab openers, pull-tab openers, and the like. The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, does not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A container comprising:

a one piece aluminum body portion defining a sidewall and a bottom, said sidewall having an upper edge;

a cover coupled to the upper edge of said sidewall and defining a rim portion; and wherein said bottom portion has a central concave panel surrounded by an annular region which defines a convex shape, with a plurality of discrete foot regions extending downwardly from portions of said annular region.

2. A container, as claimed in claim 1, wherein said foot regions each define a substantially arcuate shape, substantially concentric with a perimeter region of said sidewall.

3. A container, as claimed in claim 1, wherein at least some of said foot portions are sized and shaped to nest within said rim portion of said cover of an adjacent stacking container.

4. A container, as claimed in claim 1, wherein said foot portions collectively occupy at least about 200° of the circumferential extent of said bottom portion.

5. A container, as claimed in claim 1, wherein said gauge thickness of said sidewall is less than about 0.20 mm.

6. A container, as claimed in claim 1, wherein said convex shape is a curvilinear shape.

7. A container, as claimed in claim 1, wherein said plurality of discrete feet are spaced-apart defining at least a first radial location on said bottom portion, and an inter-foot gap wherein the smallest said inter-foot gap between adjacent feet occupies a circumferential extent of at least about 3° along said convex surface.

* * * * *